US005740057A

United States Patent [19]

Futamura

[11] Patent Number: 5,740,057

[45] Date of Patent: Apr. 14, 1998

[54] EMBROIDERY DATA CREATING DEVICE

[75] Inventor: Masao Futamura, Nagoya, Japan

[73] Assignee: Brother Kogyo Kabushiki Kaisha, Aichi-ken, Japan

[21] Appl. No.: 558,673

[22] Filed: Nov. 16, 1995

[30] Foreign Application Priority Data

Nov. 22, 1994 [JP] Japan ..... 6-287664

[51] Int. Cl.[6] ..... D05B 21/00

[52] U.S. Cl. ..... 364/470.09; 364/470.07; 364/470.08; 112/102.5; 112/470.06; 112/475.19

[58] Field of Search ..... 364/470.09, 470.08, 364/470.07; 112/102.5, 470.06, 475.19, 262.3

[56] References Cited

U.S. PATENT DOCUMENTS

| | | | |
|---|---|---|---|
| 4,958,301 | 9/1990 | Kobayashi | 364/521 |
| 4,960,061 | 10/1990 | Tajma et al. | 112/103 |
| 4,982,674 | 1/1991 | Hayakawa | 364/470.09 |
| 5,054,408 | 10/1991 | Hayakawa | 112/266.1 |
| 5,148,294 | 9/1992 | Kurogane et al. | 358/448 |
| 5,179,520 | 1/1993 | Hayakawa | 364/470.09 |
| 5,231,586 | 7/1993 | Shimizu | 364/470.09 |
| 5,320,054 | 6/1994 | Asano | 112/112.12 |
| 5,335,182 | 8/1994 | Asano | 364/470.09 |
| 5,386,789 | 2/1995 | Futamura et al. | 112/121.12 |
| 5,390,126 | 2/1995 | Kongho et al. | 364/470.09 |
| 5,558,033 | 9/1996 | Futamura et al. | 364/470.09 |

OTHER PUBLICATIONS

JP Provisional Publication No. HEI 7–236784 published on Sep. 12, 1995 and corresponding to U.S. Serial No. 08/391,170.

JP Provisional Publication No. HEI 4–174699 published on Jun. 22, 1992 with the English JP Abstract thereof.

*Primary Examiner*—James P. Trammell
*Assistant Examiner*—Hien Vo
*Attorney, Agent, or Firm*—Kane,Dalsimer,Sullivan, Kurucz, Levy, Eisele and Richard, LLP

[57] ABSTRACT

There is provided an embroidery data creating device, in which image data is obtained by scanning a figure, and then closed areas surrounded by a connected line are determined in accordance with the image data. The closed areas are displayed on a screen of a display. A user can designate an area on the screen, and an attribute, e.g., a color, to be applied to the area. After attributes for all the areas are determined, the embroidery data is created.

27 Claims, 13 Drawing Sheets

EMBROIDERY DATA CREATING DEVICE

BACKGROUND OF THE INVENTION

The present invention relates to data creating devices that create embroidery data for use with personal sewing machines.

Presently, there are data creating devices that create embroidery data for use with industrial sewing machines. These data creating devices are computer controlled and are capable of creating high-accuracy, multi-color embroidery data in a relatively short period of time. Usually these data creating devices are provided with a computer, an image scanner, a hard disk drive, and a CRT display, etc.

Recently, as the performance of personal sewing machines has improved, an embroidery data creating device for use with the personal sewing machine has been sought to satisfy an expanding demand. However, the data creating devices for the industrial sewing machines are complicated, expensive, and are not easy to operate for personal use. Therefore, an inexpensive, easily operable data creating device has been desired. Preferably, such devices are capable of creating multi-color embroidery data using a plurality of color threads.

An embroidery data creating device for personal use was disclosed in Japanese Patent Provisional Publication HEI4-174699. The disclosed data creating device is provided with a microcomputer, a small display, and a keyboard. The device is connected with a monochrome image scanner, and creates the embroidery data as described below.

Assume that an embroidery data of a FIG. A shown in FIG. 5 is to be created. In FIG. 5, the FIG. A consists of four embroidery areas: a "flower" A1; a "stem" A2; and a pair of "leaves" A3 and A4. In FIG. 5, different threads are used for different colors. In FIG. A, the areas A3 and A4 have the same color while the other areas have different colors. Therefore, the embroidery data for the FIG. A requires three different colors.

According to the method disclosed in the Provisional Publication HEI 4-174699, three monochromatic originals B1 through B3 are to be prepared, as shown in FIGS. 13A through 13C. On each original, the areas having the same color are drawn. Therefore, for a pattern having three colors, the three originals B1 through B3 are required. Each of the originals B1 through B3 is scanned separately, and embroidery data for the corresponding color is created.

In the above method, a plurality of originals corresponding to the colors used must be prepared. This is a time consuming process. Further, the positioning of each of the originals must be accurate, when each of the originals is scanned, otherwise the originals (and therefore the different colored areas) may be shifted in position, with respect to each other.

In order to avoid a shift in position between the respective color data, the applicant suggested, in Japanese Patent Provisional Publication HEI6-27734, an improved method, which will be briefly described below.

According to the improved method, a primary original having an outline of the entire area to be embroidered, is prepared. Then, a secondary original having the outline of the entire area to be embroidered, as well as an indication of the areas having the same color, is prepared. In the secondary originals, previously indicated areas can be indicated together with a newly indicated area having a color different from any one of the previously indicated areas.

Since the outline of the entire embroidery area is shown in both the primary original and each of the secondary originals, the positioning of the embroidery data can be accurately determined after the originals are scanned. However, this is still a time consuming process since the original must be scanned a plurality of times.

SUMMARY OF THE INVENTION

It is therefore an object of the invention to provide an improved embroidery data creating device and method with which an accurate embroidery data can be created with a simple operation.

For the above object, according to the invention, there is provided a method of determining attributes for parts of figures used to create embroidery data, comprising the steps of: inputting image data; determining closed areas surrounded by a connected line; displaying the closed areas on a screen; designating one of the closed areas; and applying an attribute to the designated one of the closed areas.

Optionally, the step of inputting comprises a step of scanning an original on which a figure is drawn. The attribute is at least one of color, density, pattern, pitch, and direction of stitch. It is possible to modify the method such that some of the attributes can be applied to all the areas, and thereafter individual attribute setting is changed.

According to another aspect of the invention, there is provided an embroidery data creating device for creating data to be used by a sewing machine, the device comprising: an image data inputting device for obtaining an image data; means for determining areas of the image on which stitches are to be made; means for displaying the areas determined by the determining means; means for designating one of the areas displayed on the displaying means; means for selecting an attribute which is to be applied to the one of the areas designated by the designating means; and means for creating the embroidery data, the embroidery data including information of the areas and attributes for the respective areas.

Optionally, the image data inputting device includes an image scanner, wherein a bit-map image data is input to the embroidery data creating device. The bit-map image may be created by a scanner, a digitizer or an output of a computer.

Further optionally, the determining means comprises means for detecting edges and outlines of the image, and means for determining closed areas surrounded by the edges and outlines, the closed areas being determined as the areas on which stitches are made. The determination may be made in accordance with the bit-map image.

Furthermore, an area designated by the designating means are displayed in different way from the other areas. For example, the designated area blinks on the screen, while the other areas are continuously lit.

Still optionally, the areas are given priorities, and wherein the designating means has an operation member, the areas are designated one after another in response to an operation of the operation member. For example, the priorities are determined in accordance with a distance of each area with respect to a predetermined reference portion of the image.

Further optionally, areas to which the attributes have been given are displayed in different way from those to which the attributes have not yet been assigned. For example, the areas to which the attributes have been given are filled with a pattern different from that filling the areas to which the attributes have not yet been assigned.

Optionally, the attribute includes a color of thread, and a predetermined number of plurality of colors are listed on the display. The plurality of colors may be indicated by name, and the selecting means has an operation member to select one of the names of colors on the screen. Alternatively, the colors can be indicated by actual colors if a color display is employed.

Further optionally, the embroidery data includes data of colors of threads to be used. Alternatively, only the information that the exchange of threads can be stored instead of the color information.

Further, the embroidery data includes sewing order of the areas. The order may be determined such that the areas having the same color are sewn subsequently before the areas having different colors are sewn. Furthermore, the embroidery data includes a name of the embroidery data.

According to still another aspect of the invention, there is provided an embroidery data creating device for creating embroidery data, comprising: an image data inputting means for inputting an image data representing a figure of an embroidery; a displaying means for displaying embroidery areas which correspond to the at least one closed area; means for assigning priorities of the at least one closed area in accordance with the image data; means for designating one of the at least one closed area; and means for setting an attribute to the one of the closed areas designated by the designating means.

According to further aspect of the invention, there is provided an embroidery data creating device for creating data to be used by a sewing machine, the device comprising: an image data inputting device for obtaining an image data; means for determining areas of the image on which stitches are to be made; means for displaying the areas determined by the determining means; means for designating at least one of the areas displayed on the displaying means; means for selecting an attribute of an embroidery; means for applying the attribute selected by the selecting means to the at least one of the areas; and means for creating the embroidery data, the embroidery data including information of the areas and attributes for the respective areas.

Optionally, a color can be selected first, and areas having the selected color can be designated thereafter.

Further optionally, an operating member for terminating the procedure of designating areas and selecting attributes even if attributes for all of the areas have not yet assigned. In this case, upon operation of the operating member, an embroidery data for only a part of the figure, which corresponds to the areas to which the attributes have been assigned, is created.

DESCRIPTION OF THE ACCOMPANYING DRAWINGS

DESCRIPTION OF THE EMBODIMENTS

Figure 1:
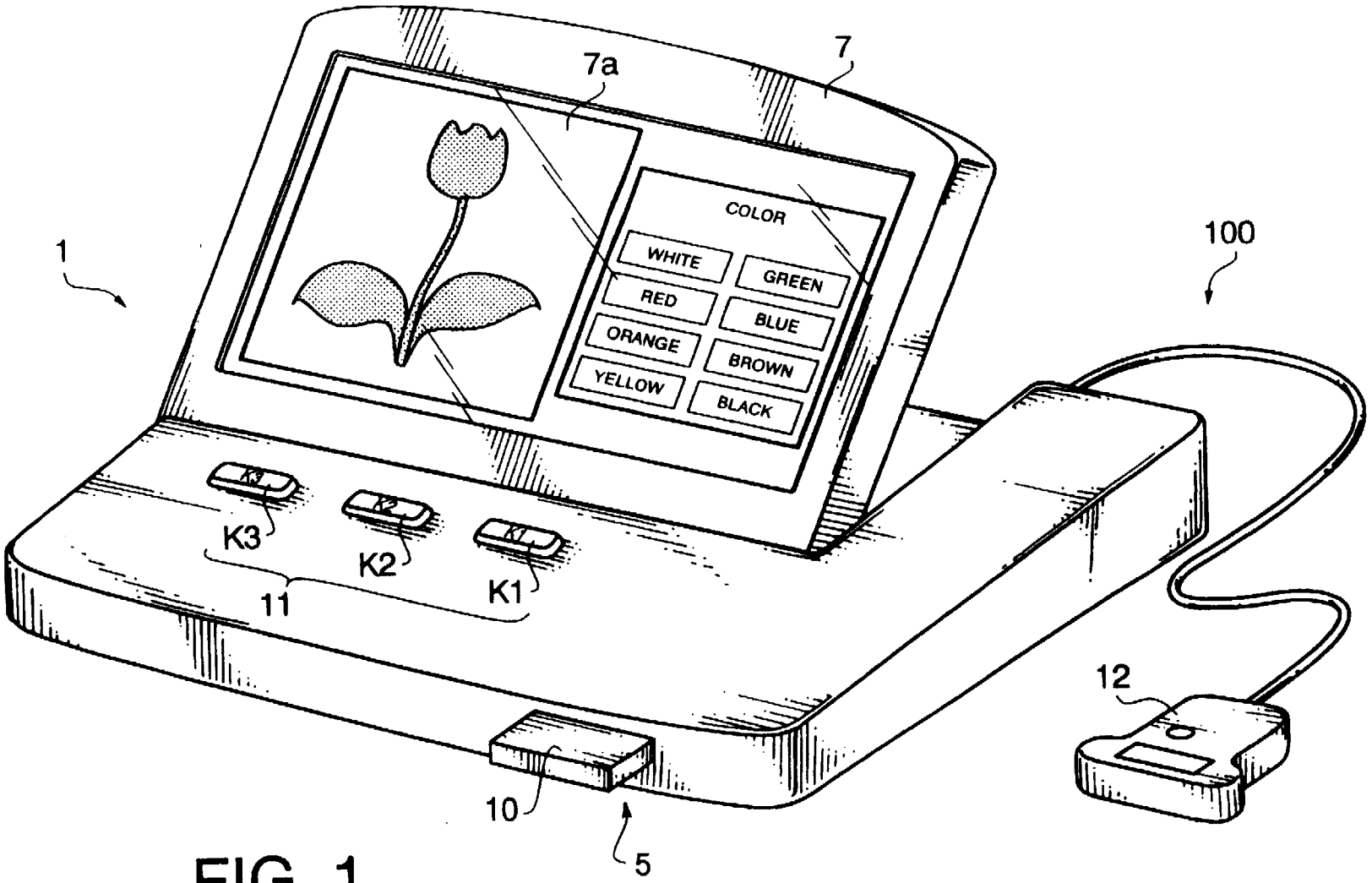
FIG. 1 shows an appearance of an embroidery data creating device, according to an embodiment of the present invention.
Figure 2:
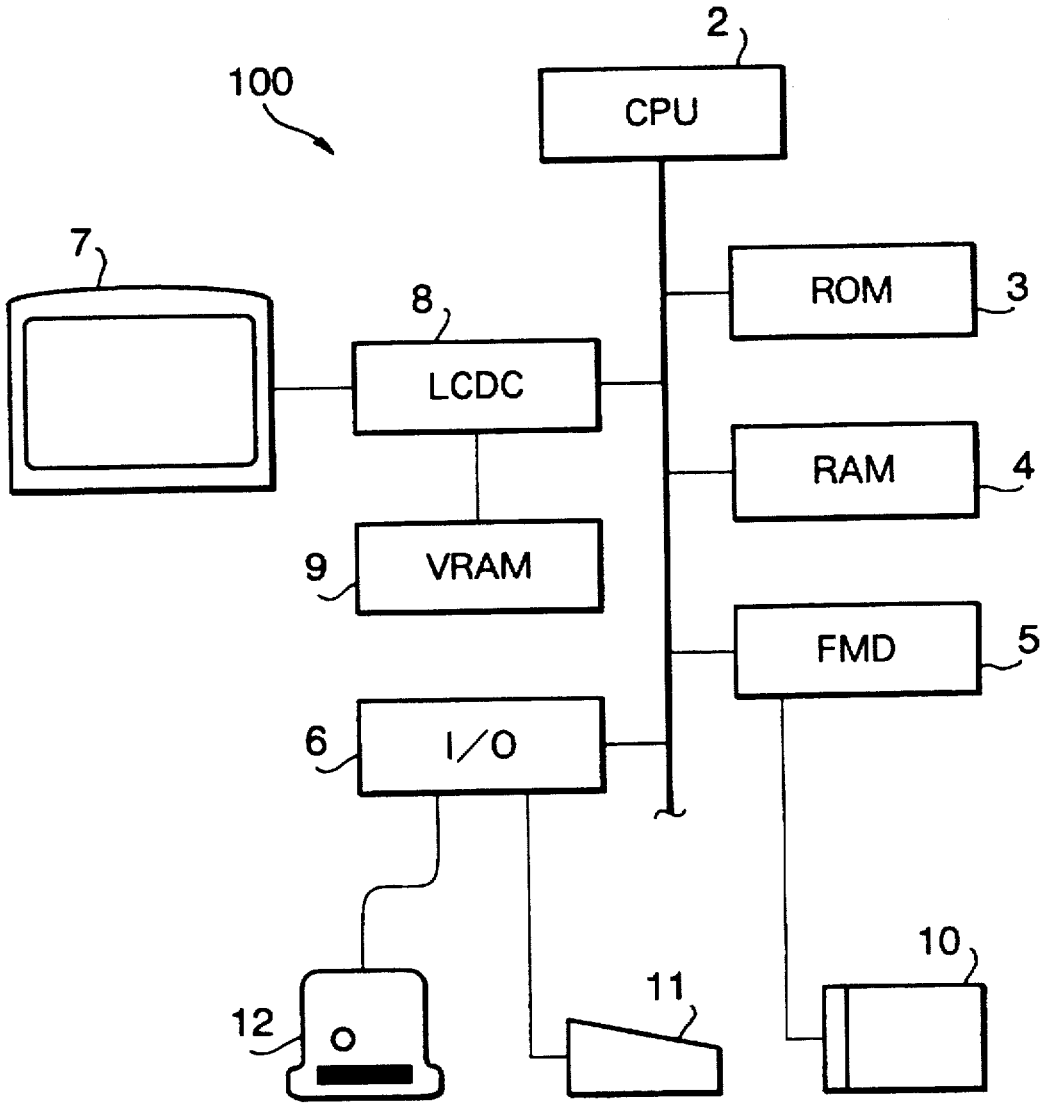
FIG. 2 is a block diagram of the embroidery data creating device shown in FIG. 1.

FIG. 1 shows an embroidery data creating device 100 according to a preferred embodiment of the present invention. FIG. 2 shows a block diagram of the embroidery data creating device shown in FIG. 1.

Figure 4:
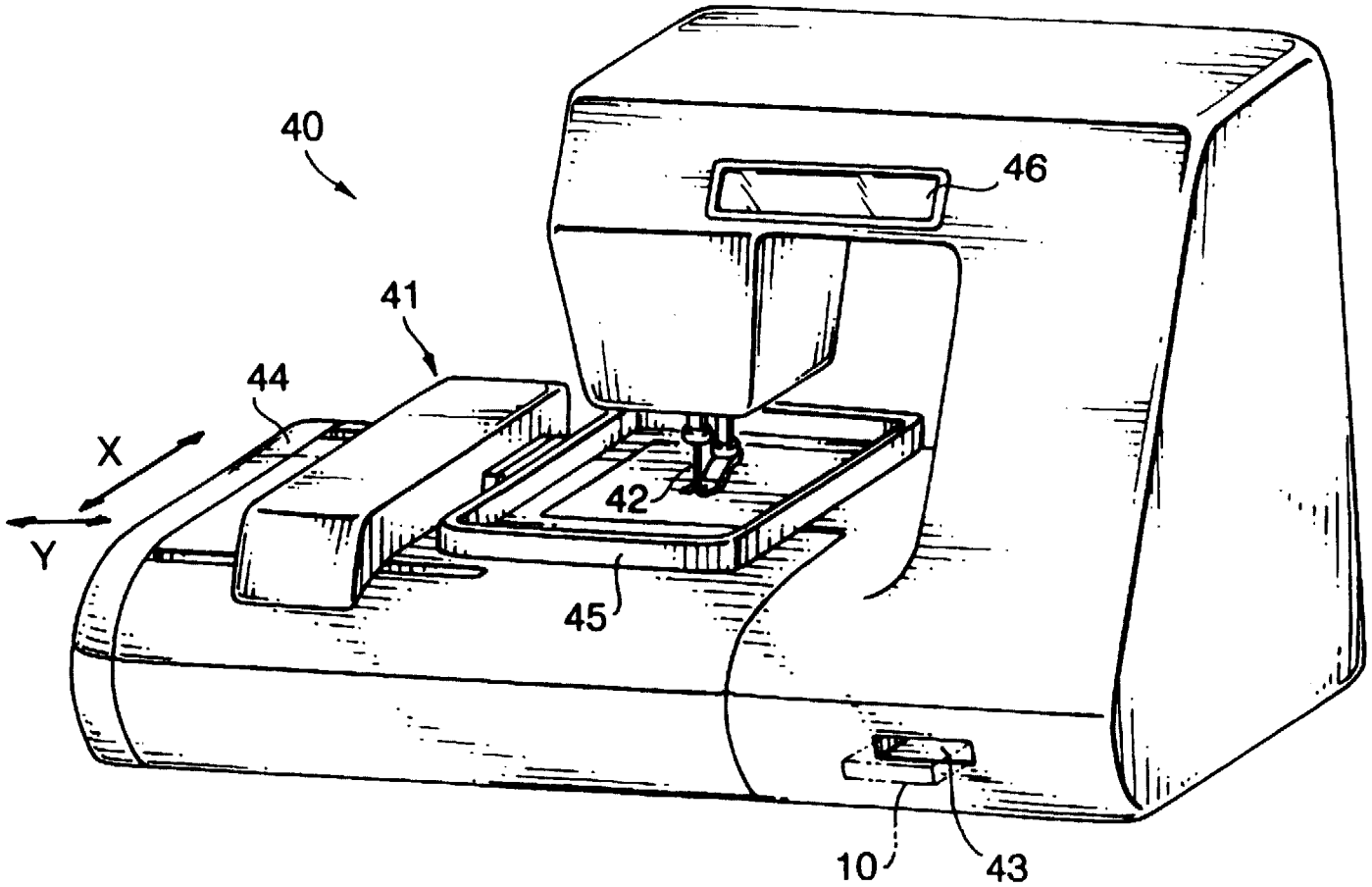
FIG. 4 shows a sewing machine which uses the embroidery data created by the embroidery data creating device.

The data created by the embroidery data creating device 100 is used in a personal sewing machine, such as the sewing machine shown in FIG. 4.

In FIG. 4, an embroidery sewing machine 40 has a bed 44, a frame 45 for supporting a work sheet, an X-Y feed mechanism 41 for displacing the frame 45 to any position in a horizontal plane defined by the X-Y coordinate system prescribed for the sewing machine 40. A sewing needle 42 conveys a color embroidery thread that is changeable with a different needle thread having a different color, by a user. Under the bed 16, a loop catcher for catching a loop of the thread conveyed by the needle 42 is provided. Further, there are a drive mechanism for vertically reciprocating the needle 42, and rotating the lop catcher synchronously with the reciprocating movement of the needle 42. The operations of the drive mechanism and the X-Y feed mechanism 41 are controlled by a control device including a microcomputer to form the color embroidery in accordance with the embroidery data stored in the flash-memory card 10.

The embroidery data includes sets of stitch-position data (e.g., X and Y coordinated data) which represent respective stitch positions where the sewing needle 42 penetrates the work sheet to form corresponding stitches. Each set of stitch-position data represents respective amounts of movement of the work sheet or the embroidery frame 18 along the X and Y axes to form a corresponding stitch.

As shown in FIG. 4, the sewing machine 40 has a card insertion unit 43 for reading embroidery data from a flash-memory card 10 which is inserted therein. The flash memory is an EEPROM (Electrically Erasable and Programmable Read Only Memory). The embroidery data creating device 100 according to the invention creates the embroidery data and stores the data in the flash-memory card 10. Alternatively, the data creating device 100 may directly be connected through a data cable to the sewing machine 40 so that the embroidery data created by the data creating device 100 can directly be transferred to the control device of the sewing machine 40. Otherwise, the data creating device 100 as a whole may be incorporated into the sewing machine 40 of FIG. 4.

The sewing machine 40 has a display device 46 for displaying various messages directed to the user, for example, a message requesting the user to change the currently used thread with a new thread having a different color.

As shown in FIG. 1, the embroidery data creating device 100 has a main body 1 and an image scanner 12. The top surface of the main body 1 has an LCD (liquid crystal display) 7. The LCD 7 has a screen 7a for displaying a scanned image and the embroidery areas. A flash memory device 5 is provided on the front side surface of the main body 1. A flash memory 10, which is used as a recording medium is detachably inserted into the flash memory device 5. Further, a key board 11 having three operation keys (i.e., an area changing key K1; a color selecting key K2; and a color setting key K3) for inputting selection and/or commands is provided on the top surface of the main body 1.

As shown in FIG. 2, the embroidery data creating device 100 has a CPU 2, a ROM 3, a RAM 4, the flash memory device 5, and an I/O interface 6, which are connected with each other through a bus line. A VRAM 9 is connected to an LCD controller 8 which controls the display on the screen 7a in accordance with a bit-map stored in the VRAM 9. The image scanner 12 and a key board 11 are connected to the CPU 2 through the I/O interface 6.

The image scanner 12 is a monochromatic hand-held scanner that is moved by an operator across an image to be scanned. When the reading section of the scanner 12 faces the image, and is moved along a certain direction while a reading button is depressed, the scanner 12 scans the image and creates binary (ON or OFF) data. The binary data is a raster formatted bit-map having a value of 0 when a corresponding pixel is white, and a value 1 when a corresponding pixel is black. The binary data is stored in a predetermined area of the RAM 4. The embroidery creating device 100 creates the embroidery data based on the original as shown in FIG. 5.

Figure 3:
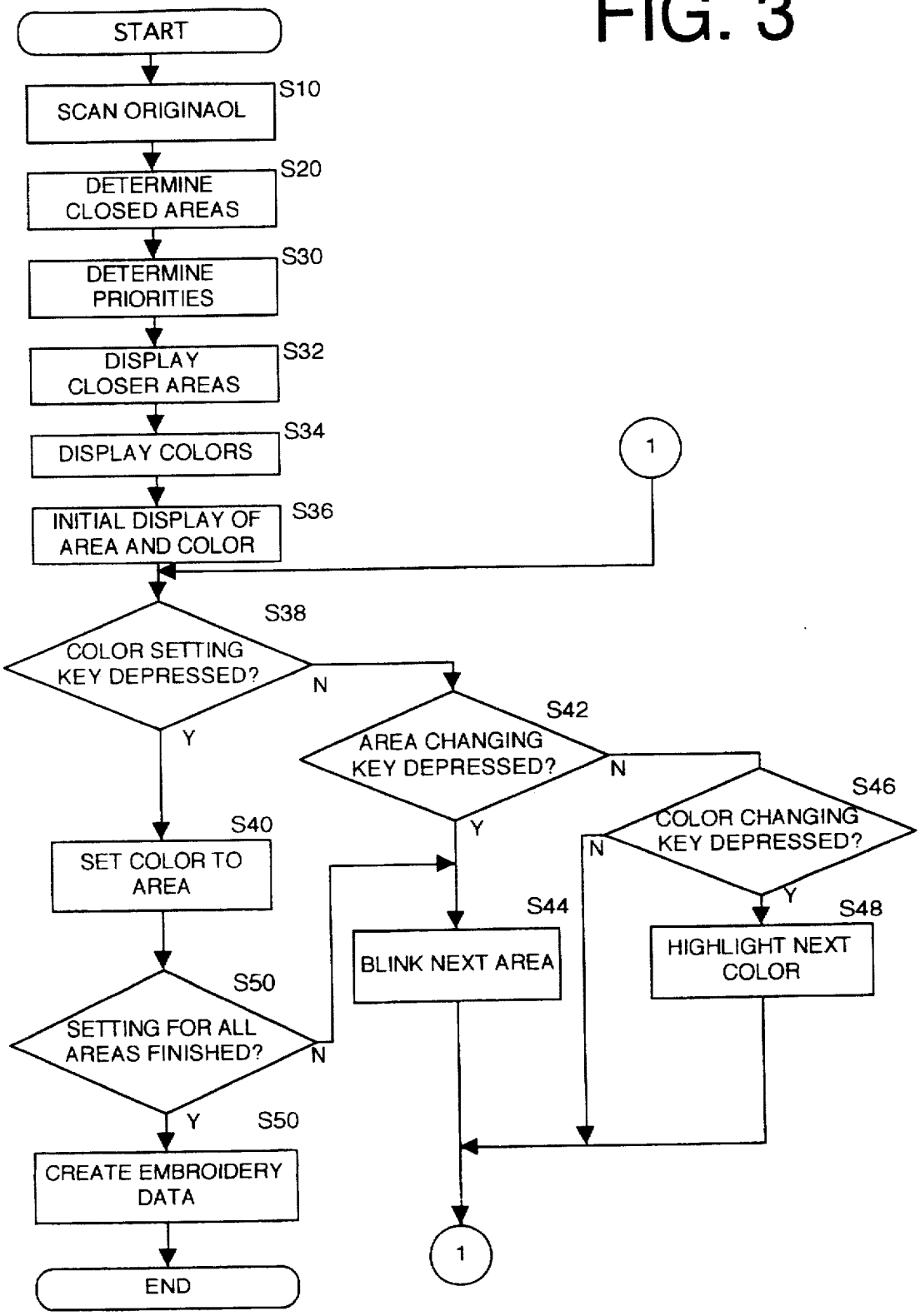
FIG. 3 is a flowchart illustrating an operation for creating the embroidery data.

FIG. 3 is a flowchart illustrating an operation for creating the embroidery data. The operation is stored in the ROM 3 as a program. In the flowchart, attribute data such as the shape, density, pitch, or direction, etc., of the stitch, is not given. These attributes are set when the power is turned ON by the operator, and are applied to all of the embroidered areas.

Figure 5:
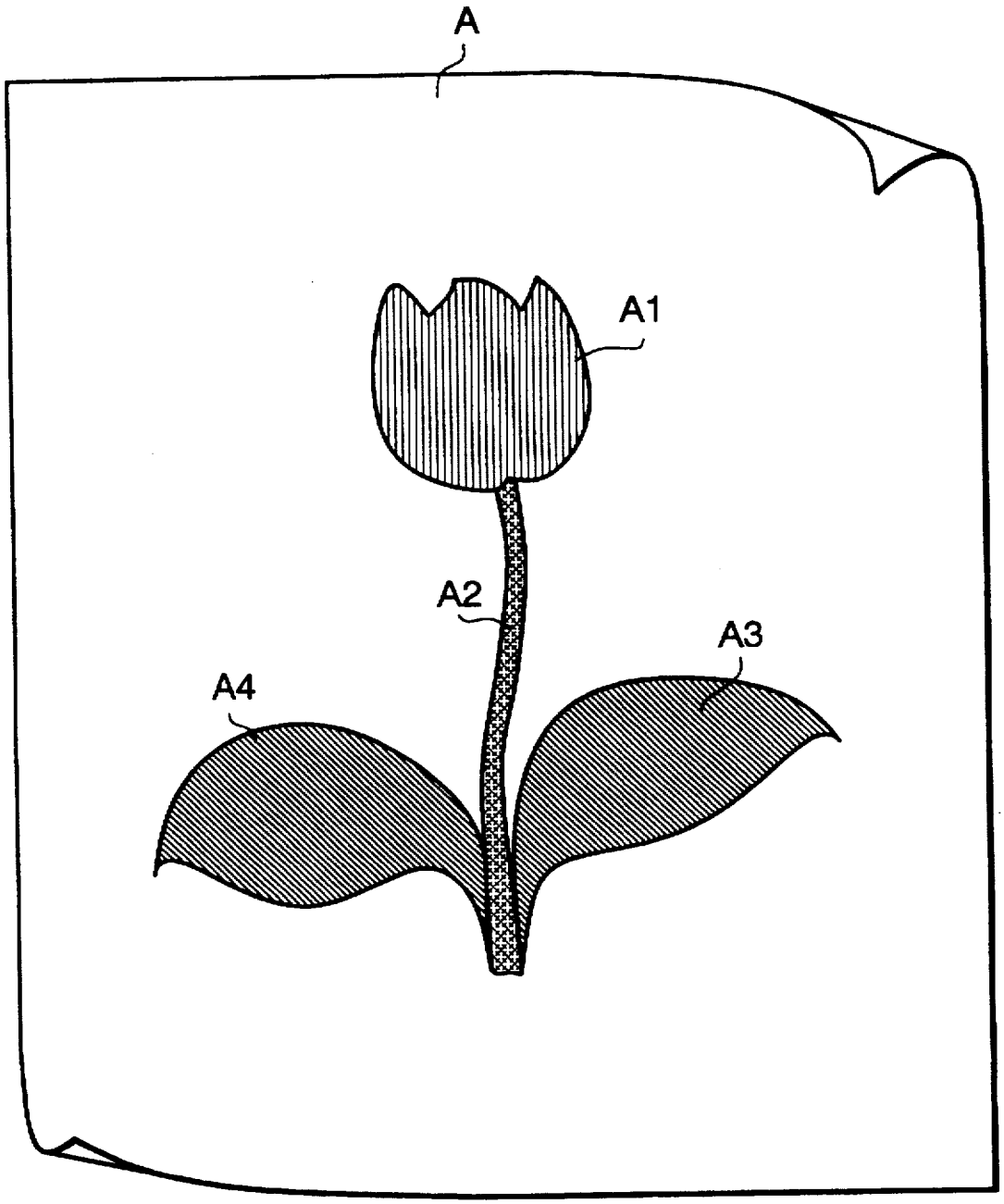
FIG. 5 shows an example of an embroidery pattern that is to be made by the sewing machine shown in FIG. 4.
Figure 6:
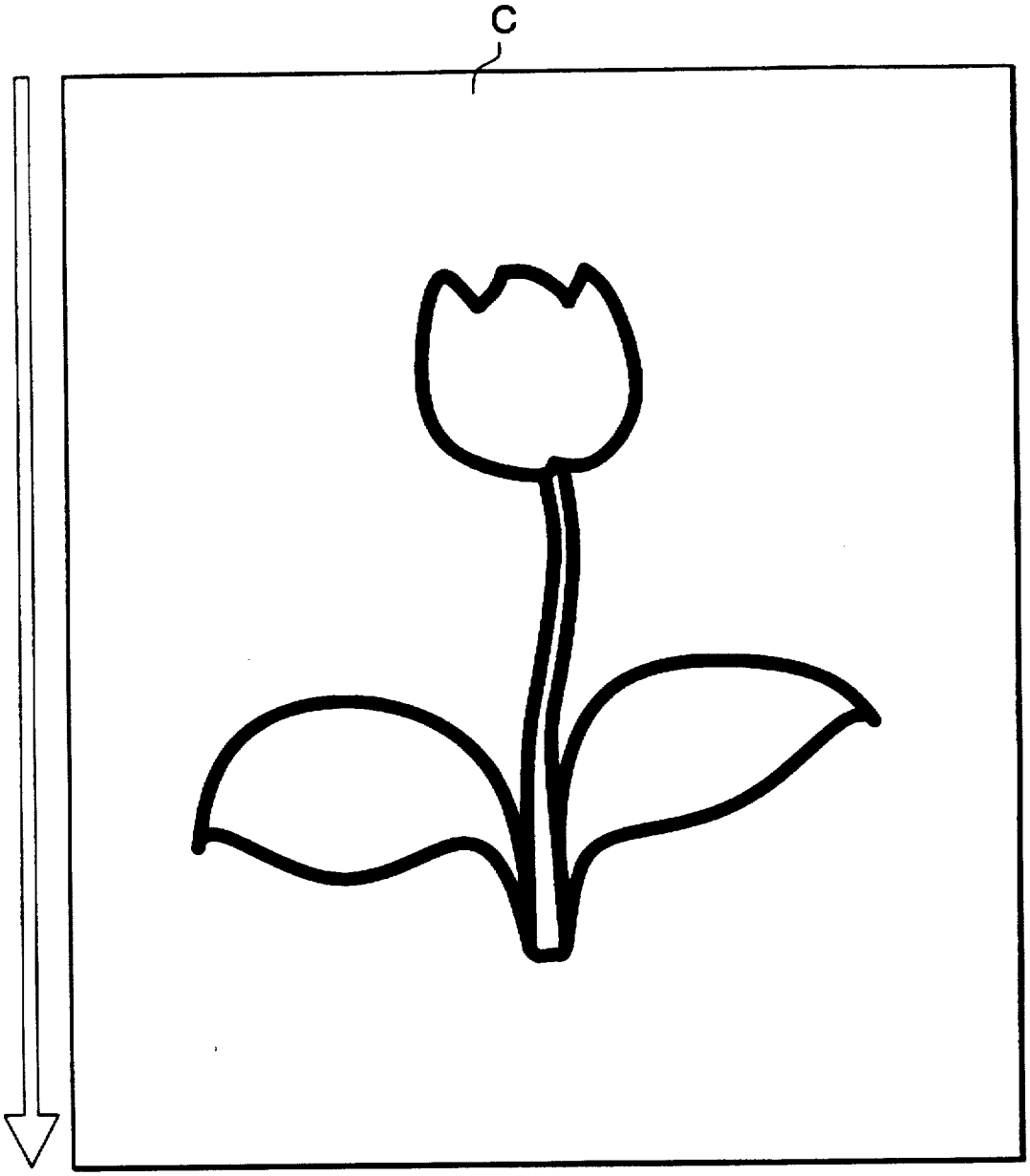
FIG. 6 shows an example of an original that is scanned to create embroidery data.

In order to create the embroidery data, the operator is required to prepare an original C (shown in FIG. 6) which corresponds to the outline and edges of the FIG. A shown in FIG. 5. For example, the original C may be made by tracing the outline and edges of the FIG. A with a black pen on white paper.

Initially, the operator operates the image scanner 12 to read the FIG. C. The bit-map image data is stored in the predetermined area of the RAM 4, in step S10. After the original C has been scanned, an edge detection procedure is executed in step S20. In the edge detection procedure, figures consisting of connected black pixels are detected in order to determine closed areas (i.e., areas which are surrounded by a chain of adjacent black pixels). This procedure is performed using a well-known border following algorithm for sequentially tracing border points of pixels. For determining the connectivity, either 4-neighbor or 8-neighbor determination is applicable. In the 4-neighbor determination, the pixels located horizontally (right and left) and vertically (upwardly and downwardly) adjacent to the current pixel are examined. In the 8-neighbor determination, further to the horizontally and vertically adjacent pixels, four diagonally adjacent pixels are also examined. However, any other edge detection method such as a method using a Fourier expansion can also be used for the algorithm executed in step S20, and therefore the algorithm itself will not be described in detail.

Figure 7:
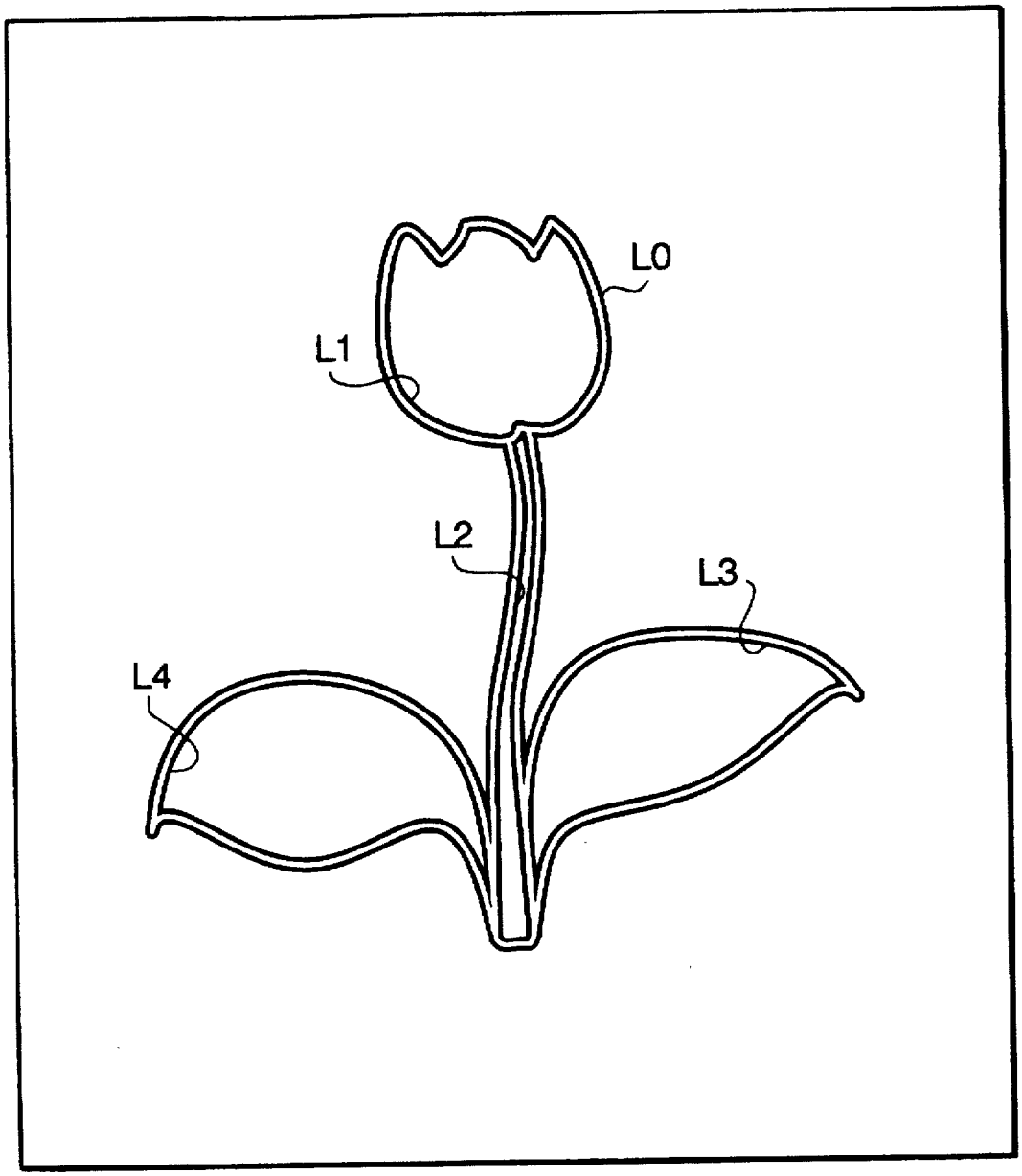
FIG. 7 shows outlines generated in accordance with a bit-map data.

FIG. 7 shows the lines corresponding to the edges detected during step S20. The lines are L0, L1, L2, L3 and L4. In FIG. 7, the edges are indicated by lines, but the edges actually consist of horizontally and/or vertically connected black pixels.

The line L0 is a line defining the outer edge (outline) of the figure, while the lines L1 through L4 define closed areas such as the "flower", "stem" or "leaves" areas, which are included within the area defined by the line L0. In the following steps, the embroidery data is created for these closed areas which are included in the outline defined by the line L0.

The distance of the closed areas with respect to the position where the scanning is started is calculated based on the bit-mapped image data, and an order for each area is assigned, in step S30. In the preferred embodiment, the "flower" is the closest, followed by the "stem", the "right leaf", and the "left leaf" in order. In other words, it is determined that the "flower" was scanned first, the "stem" was scanned second, the "right leaf" was scanned third, and the "left leaf" was scanned fourth. The order is stored in the order storage area of the RAM 4. In the program, the order of the areas is stepped through in a cyclic manner (i.e., the "flower" is followed by the "stem", "right leaf", "left leaf", and then the "flower" again).

Figure 8:
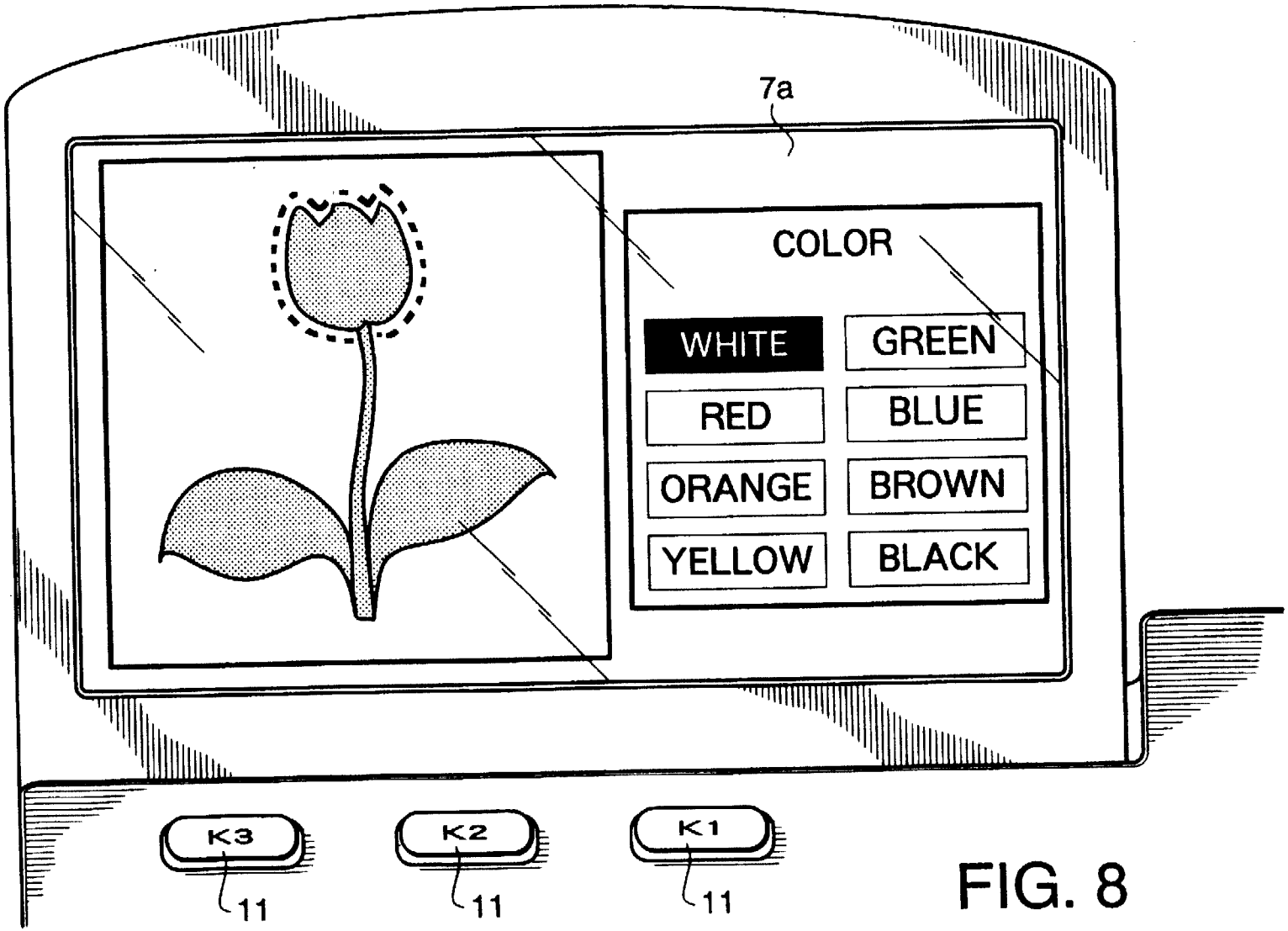
FIGS. 8 through 11 are example screen images of the embroidery data creating device.

The closed areas defined by lines L1 through L4 are rescaled in accordance with the size of the screen 7a, and the data of the re-scaled image is transmitted to a display memory 9. When the areas are re-scaled, each area is filled with a certain pattern. In step S32, the image is displayed on the screen 7a, under control of display controller 8. An example of the displayed image is shown in FIG. 8. In the preferred embodiment, the pattern has alternating black and white pixels (checkered pattern). Such a pattern can easily be formed using a well-know fill algorithm, and will not be described in detail. The pattern is not limited to one described above, but any pattern can be used.

The area defined by line L0 is processed in a manner similar to the processing of the closed areas, and is also displayed on the screen 7a. Since all the lines L0 through L4 and the patterns of the closed areas are displayed, the operator can easily recognize the existence of the closed areas and the number and the shapes thereof. Since the closed areas can be visually recognized, the setting of the attributes for the closed areas in the following steps can be done easily.

In step S34, a list of colors of the threads to be used for embroidering is displayed on the screen 7a, on the righthand side of the figure. A predetermined order is assigned to the colors, and upon operation of the color selecting key K2, the colors white, green, red, blue, . . . , black are sequentially highlighted (reversed displayed) in order. If the color selecting key K2 is operated when black is selected, then the color white is highlighted again. This order is also stored in the color order storage area of the RAM 4.

In steps S36 through S50, a procedure for setting an embroidery attribute (color, in this embodiment) for each closed area is illustrated.

In step S36, the "flower" area, which was given the first priority of the displayed image, blinks, and the color "white" is highlighted. This corresponds to setting the color attribute of the "flower" area with the color "white".

Step S38 determines whether the color setting key K3 is depressed. If the key K3 is depressed (S38:Y) then "white" thread is selected for embroidering the "flower" area, in step S40. Further, in step S40, the data indicating that the first area (i.e., the flower area) is to be embroidered with the white thread, is stored in the RAM 4. Furthermore, the pattern filling the "flower" section as shown in the screen 7a, is changed to a solid pattern. Since the pattern is changed when the attributes have been set, the operator can easily recognize the areas in which the attributes have not yet been assigned, from the areas in which the attributes have already been assigned.

Step S50 determines if there is an area in which the attribute has not been assigned. If there is an area in which the attributes have not been assigned (S50:N), then control goes to step S44. Otherwise (S50:Y), control goes to step S60 where the embroidery data is created, and then the operation is finished.

In step S38, if the color setting key K3 was not depressed (S38:N), then step S42 determines whether the area changing key K1 was depressed. If the area changing key was depressed (S42:Y), then control proceeds to step S44.

Figure 9:
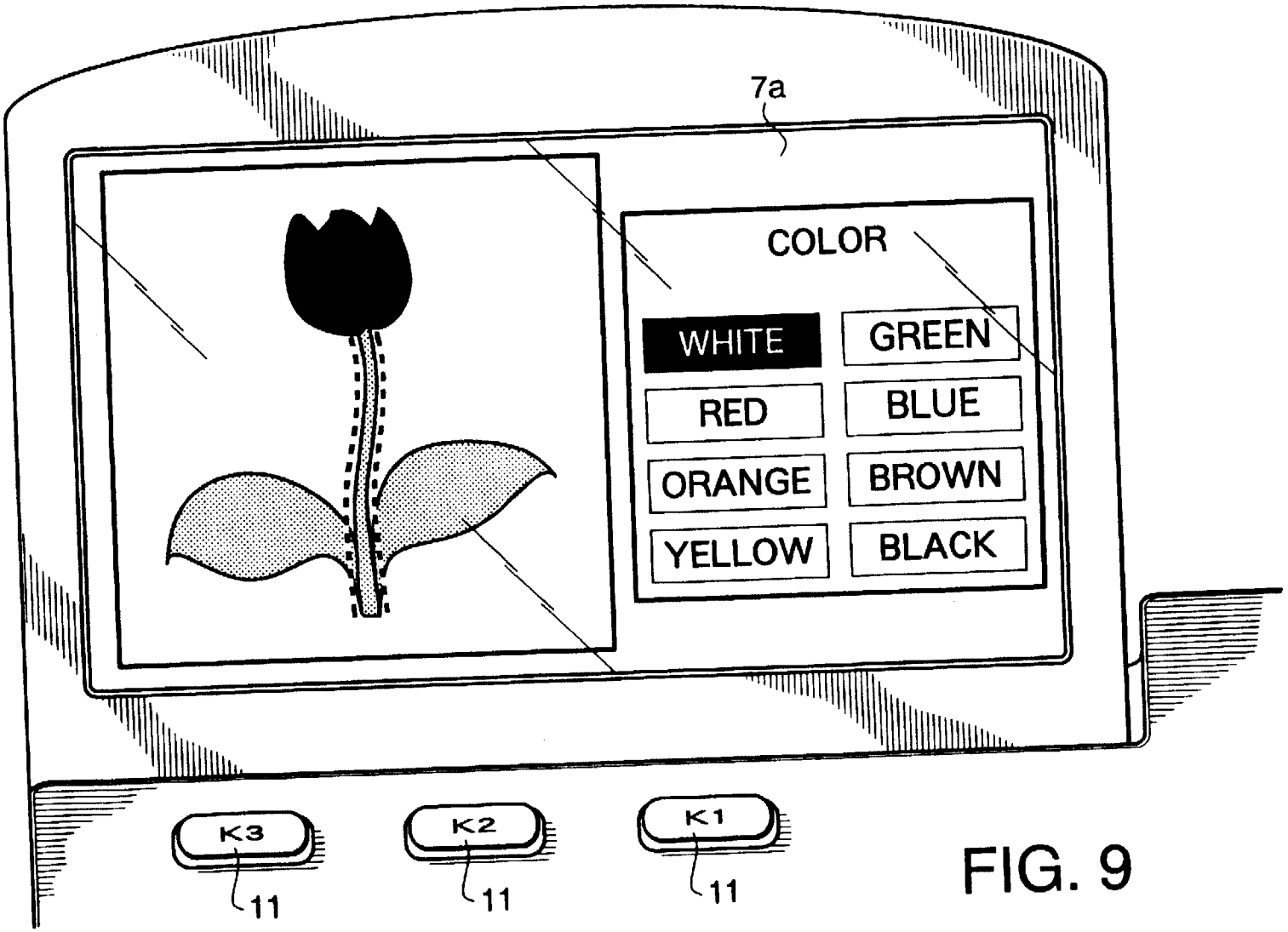

In step S44, the next area, (i.e., the area having the next order) will blink on the screen 7*a*. In this example, the "stem" area will blink, as shown in FIG. 9. Control then returns to step S38.

If the operator wishes to skip the assignment of attributes of an area, and set the attributes of the next closed area, the operator should press the area changing key K1 again until the desired area is highlighted.

Figure 10:
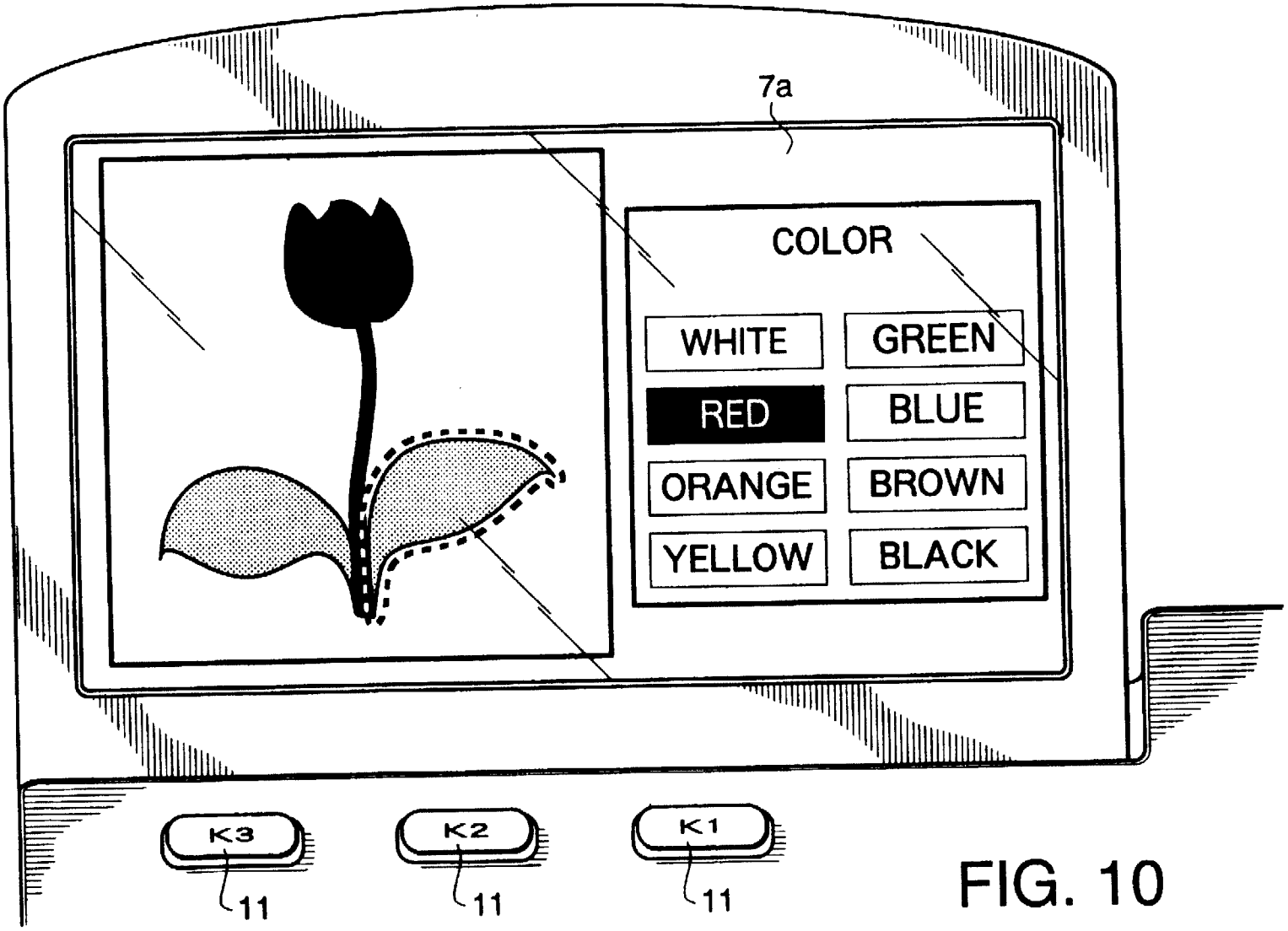

In this example, by pressing the key K1, the operator can skip the setting of the attributes for the "stem" area and proceed to the setting of the attributes for the "right leaf" area (see FIG. 10).

After the selecting the appropriate area, the operator is now ready to select a color of the thread to be used in the embroidery of the selected area. Step S46 determines whether the color selecting key K2 has been depressed. If the color selecting key K2 is depressed (S38:N,S42:N, S46:Y), then the next color is highlighted, in step S48. The operator can cycle through the colors by depressing the key K3 until the desired color is highlighted (i.e., repeat steps S38, S42,S46 and S48).

Figure 11:
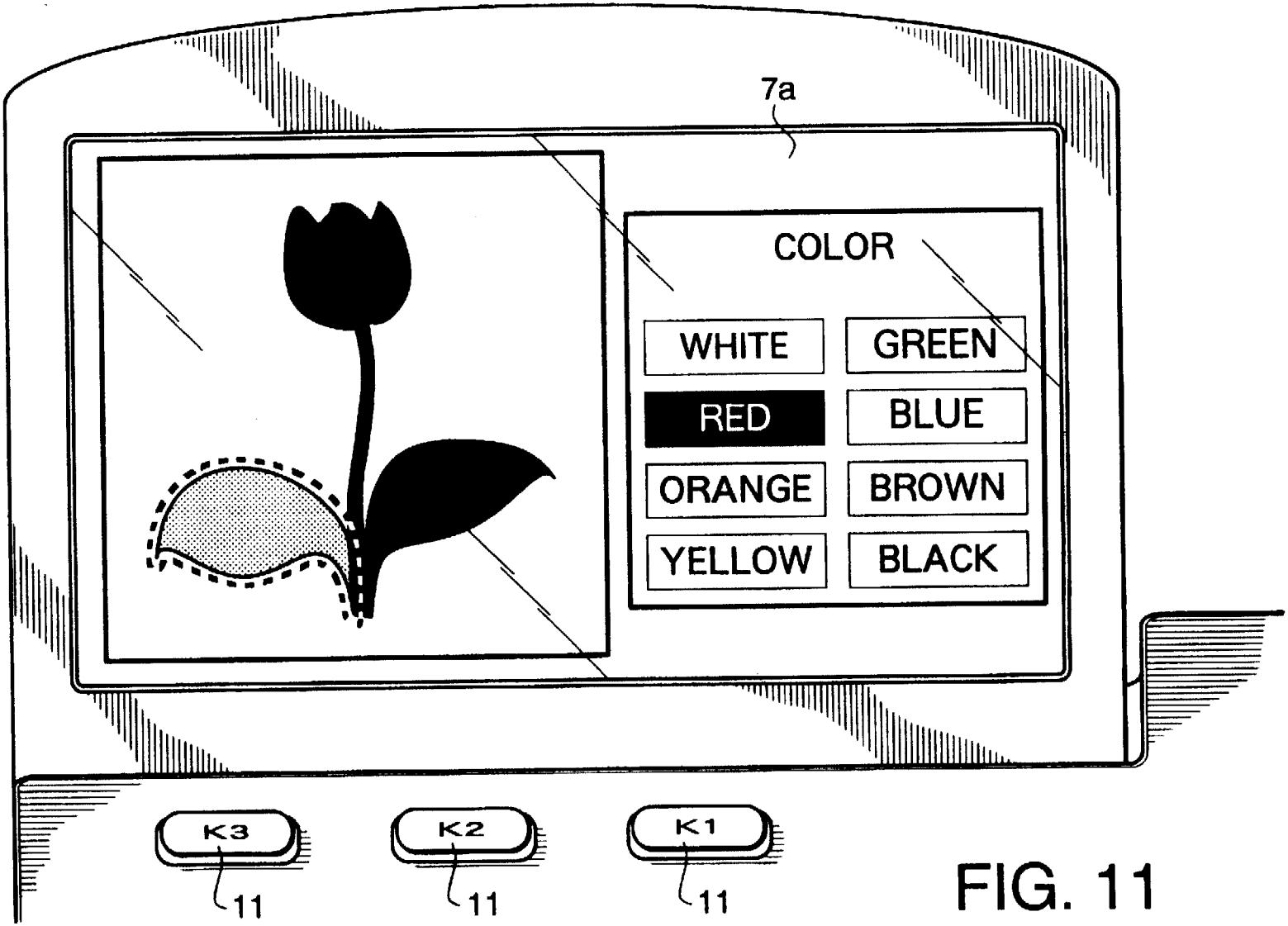

In the example, by depressing the color selecting key K2 twice the color "red" is highlighted. Then by depressing the color setting key K3, the color "red" is selected as the color for the "right leaf". Accordingly, after the color selecting key K2 is depressed twice, the image shown in FIG. 11, is displayed on the screen 7*a*.

Similarly, the color for the "left leaf" is selected, the pattern of the area is changed, and data indicating the relationship of the "left leaf" and the color is stored in the RAM 4.

During the above process, the colors for the "flower", "right leaf" and the "left leaf" have been determined. If the area selecting key K1 is depressed again after the color of the "right leaf" has been determined, control goes to step S44.

According to the assigned order, the "flower" area is designated. However, the color of the "flower" area has already been determined. Therefore, the "flower" area is skipped and the "stem" portion is displayed, in step S44. When the "stem" portion is selected (blinks), the color can be selected, in steps S38 and S40.

When the color of the "stem" portion is determined, step S50 determines that the attributes have been set for all of the closed areas, and the control goes to step S60 where the embroidery data is created. When the embroidery data is created, the locations (needle falling points) at which the predetermined stitches are to be formed are calculated. Data indicating the colors of the threads to be used for forming the embroidery is added to the location data. The order in which the embroidery is sewn corresponds to order of the colors as stored in the RAM 4. However, if there are many areas which have the same color, the embroidery data is created such that these areas are sewn sequentially.

Figure 12:
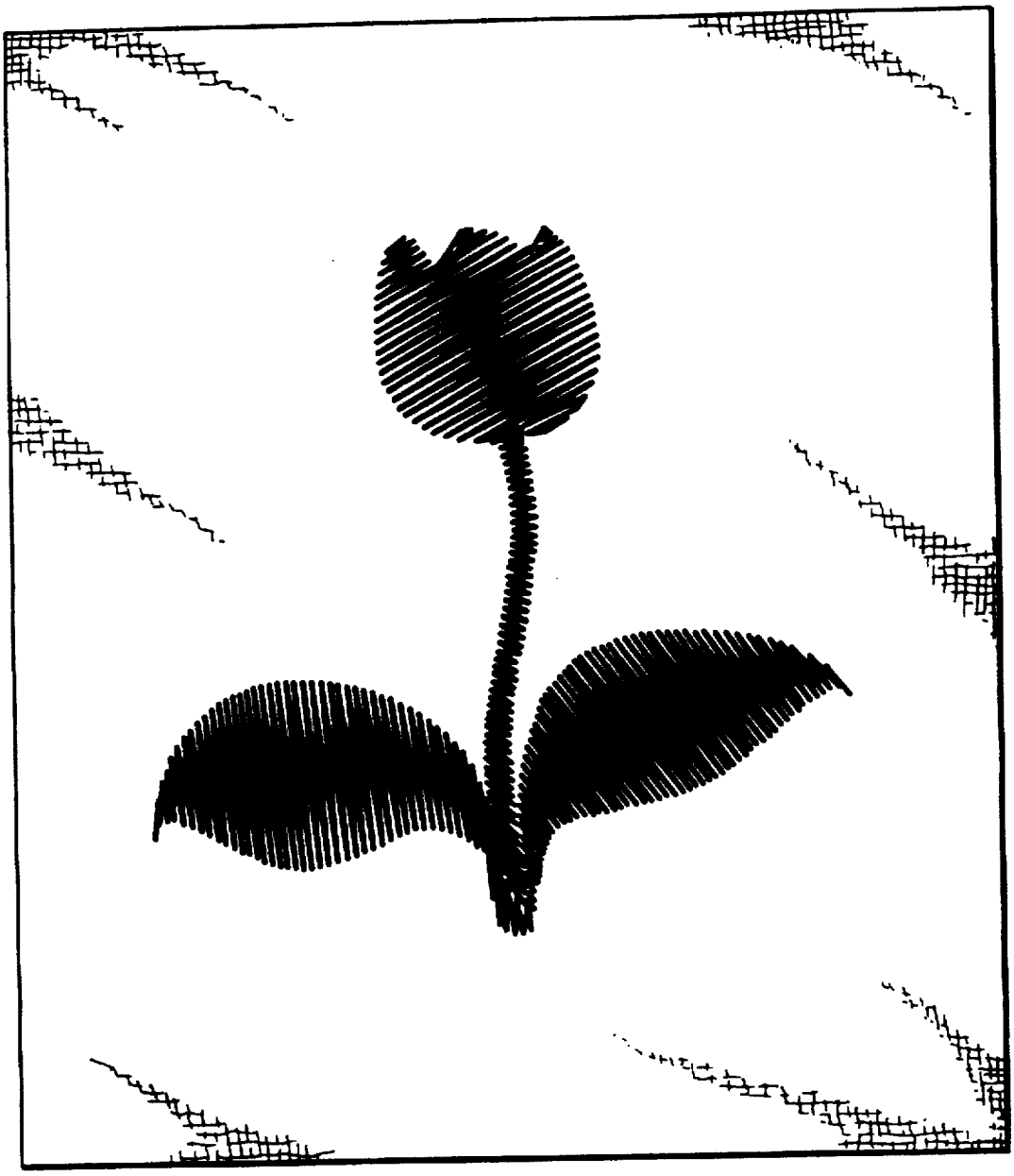
FIG. 12 is an example of an embroidery sewn (embroidered) in accordance with the embroidery data, created by the embroidery creating device.
Figure 13C:
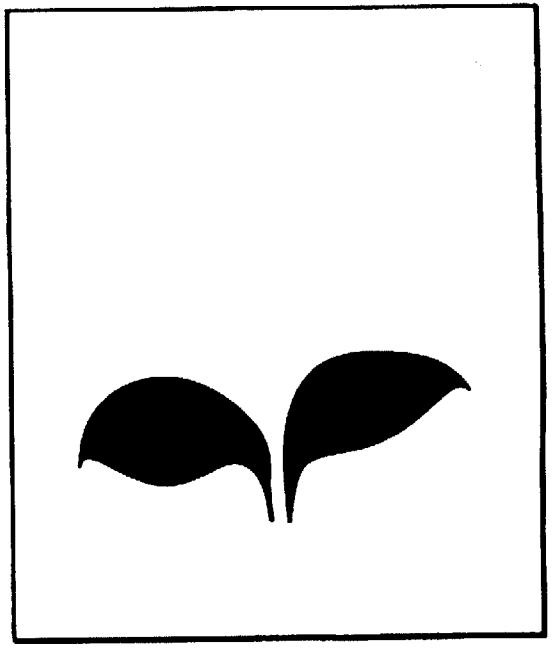
FIGS. 13A, and 13C show example of originals used in a conventional embroidery data creating device.
Figure 13B:
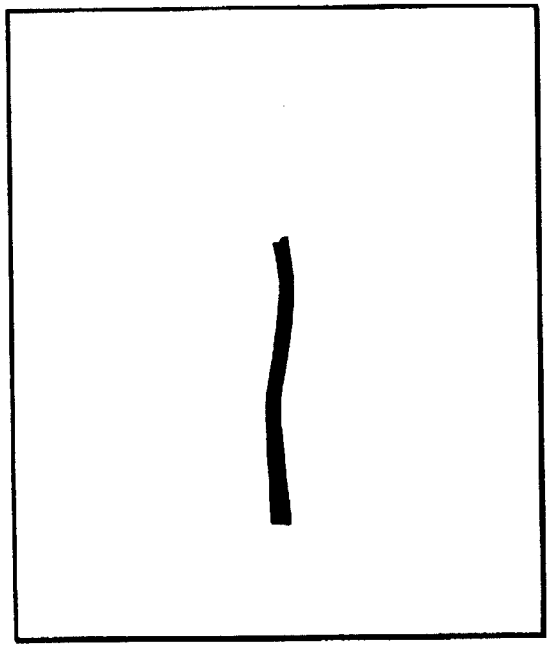
Figure 13A:
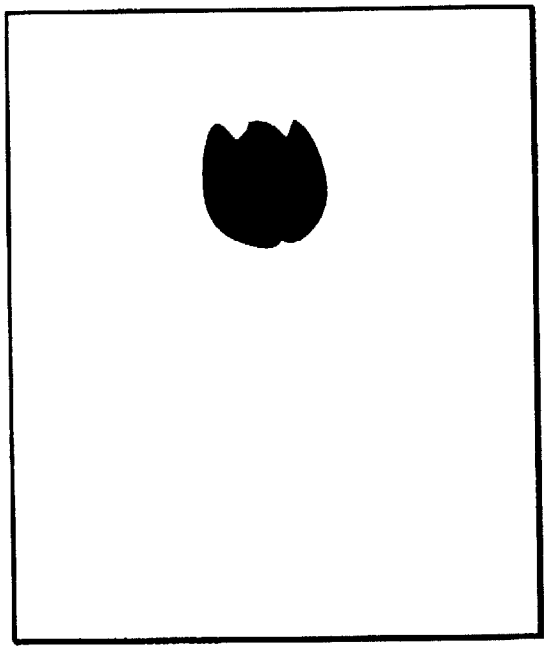

The embroidery data created as above is stored in the flash memory 10 associated with an index data of the embroidery. The index data is a reduced image which is created based on the originally scanned bit-mapped image. By inserting the flash memory 10 in the sewing machine 40, the embroidery corresponding to the FIG. A can be formed. The data of the colors of the threads is used by the sewing machine. For example, if the thread is to be changed, an audible or visual indication alerts the operator to change the thread, thereby improving the process of making the embroidery. FIG. 12 shows the embroidery formed in accordance with the data described above.

According to the preferred embodiment of the present invention, only one scanning of an original is necessary in order to create multi-color embroidery data. The areas to be embroidered are automatically determined, and further by selecting only the area and a color, or an attribute for the area, the data can be created.

Furthermore, according to the above described embodiment, the area to which an attribute has not been determined is displayed on the screen, and the data is not created until all the attributes for all the areas have been determined.

As also described above, the operator can change the area without changing the selected color. Therefore, if there are areas which have the same color, the operator can easily set the color for all the areas by selecting the areas with the area selecting key K1 and depressing the color setting key K3.

Furthermore, according to the embodiment, until the color setting key K3 is depressed, the same color can be designated even if the designated area is changed.

Still further, in the embodiment, the embroidery data for the outline of the original is not created. If this data is required, only the needle falling points within the area between the line L0, and the lines L1 through L4 need to be determined. The color for this area can be a predetermined color. Alternatively, control can be modified to determine the color of the outline.

In the embodiment, the name of the color is included in the embroidery data, and the color is indicated when the embroidery is performed by the sewing machine. If data only indicating that the exchange of thread is required, is stored in the embroidery data, the operator can select the colors while the embroidery is being sewn. Further, in step S40, the pattern of an area that has had its attributes set is changed to a solid pattern. However, by employing various patterns corresponding to a plurality of colors, the operator can recognize different embroidery areas.

Alternatively, instead of selecting a color for the respective areas, it is possible to control the embroidery such that all the areas are given a predetermined default color, and then change the colors for individual areas. In this case, if the data creating device requires that the operator checks the colors for all the areas, the operator will not forget to set the colors. Further, the device can be provided with another key which terminates the setting procedure, and initiates the data creating procedure. If such a key is provided, then it is possible to have only a part of the original made into embroidery data.

In the embodiment, only the color is selected during the procedure, and the other attributes are set once and used for all the areas. However, it is possible to provide steps to determine various attributes such as the shape, density, pitch, and direction of the stitching during steps S38 through S50.

In the embodiment, one color is determined for one area. However, it is possible to modify the control to determine one color for a plurality of areas.

The order of cycling through the closed areas displayed on the screen 7*a* is determined in accordance with the distance from the starting point of the scanning. However, the order can be reversed, or can be determined in accordance with the size of the areas, etc.

In the preferred embodiment, the embroidery areas and the attributes are displayed on the same screen 7*a*. However, these can be displayed separately so that the data can be made sufficiently large on a small screen.

Further, as described above, a hand-held scanner is used for inputting the image data. However, a desk top image scanner can be used. Furthermore, a digitizer or a CAD system can be used for inputting the original data. The display is not limited to the monochromatic display, but a color display is also effective since the embroidery areas can be recognized more easily.

What is claimed is:

1. A method of determining attributes for parts of figures used to create embroidery data, said method comprising the steps of:

inputting image data;

determining at least one closed area surrounded by a connected line;

displaying said at least one closed area on a screen;

designating one of said at least one closed area; and applying an attribute to said designated one of said at least one closed area.

2. The method according to claim 1, wherein said step of inputting comprises a step of scanning an original on which a figure is drawn.

3. The method according to claim 1, wherein said attribute is at least one of color, density, pattern, pitch, and direction of stitch.

4. An embroidery data creating device for creating data to be used by a sewing machine, said device comprising:

an image data inputting device for obtaining an image data;

means for determining at least one area of said image on which stitches are to be made;

means for displaying said at least one area determined by said determining means;

means for designating one of said at least one area displayed on said displaying means;

means for selecting an attribute which is to be applied to said one of said at least one area designated by said designating means; and means for creating said embroidery data, said embroidery data including information of said at least one area and attributes for the respective at least one area.

5. The embroidery data creating device according to claim 4, wherein said image data inputting device includes an image scanner, wherein a bit-map image data is input to said embroidery data creating device.

6. The embroidery data creating device according to claim 4, wherein said determining means comprises means for detecting edges and outlines of said image, and means for determining at least one closed area surrounded by said edges and outlines, said at least one closed area being determined as said at least one area on which stitches are made.

7. The embroidery data creating device according to claim 4, wherein an area designated by said designating means is displayed in different way from the other of said at least one area.

8. The embroidery data creating device according to claim 7, wherein said designated area blinks on said displaying means, while the other of said at least one area are continuously lit on said display.

9. The embroidery data creating device according to claim 4, wherein at least one area displayed on said displaying means is given priority.

10. The embroidery data creating device according to claim 9, wherein said priorities are determined in accordance with a distance of each of said at least one displayed area with respect to a predetermined reference portion of said image.

11. The embroidery data creating device according to claim 4, wherein each of said at least one area to which said attributes have been given is displayed in a different way from those to which said attributes have not yet been assigned.

12. The embroidery data creating device according to claim 4, wherein said attribute includes a plurality of items which are displayed on said displaying means in a form of a list.

13. The embroidery data creating device according to claim 12, wherein said attribute comprises a color of thread.

14. The embroidery data creating device according to claim 13, wherein a predetermined number of plurality of colors are listed on said displaying means.

15. The embroidery data creating device according to claim 14, wherein said plurality of colors are indicated by name, wherein said selecting means has an operation member, and wherein when said operation member is operated, names of said plurality of colors are indicated one by one.

16. The embroidery data creating device according to claim 4, wherein said embroidery data includes data of colors of threads to be used.

17. The embroidery data creating device according to claim 4, wherein said embroidery data includes sewing order of each of said at least one area.

18. The embroider data creating device according to claim 4, wherein said embroidery data includes a name of said embroidery data.

19. An embroidery data creating device for creating embroidery data, comprising:

an image data inputting means for inputting an image data representing a figure of an embroidery;

closed area determining means for determining at least one closed area surrounded by edge lines of said figure in accordance with said image data;

a displaying means for displaying embroidery areas which correspond to said at least one closed area;

means for designating one of said at least one closed area; and means for setting an attribute to said one of said at least one closed area designated by said designating means.

20. The embroidery data creating device according to claim 19, wherein said at least one closed area comprises a plurality of closed areas, and wherein said designating means designates said plurality of closed areas sequentially.

21. The embroidery data creating device according to claim 19, wherein said displaying means displays an image of said designated one of said at least one closed area differently from the other of said at least one closed area.

22. The embroidery data creating device according to claim 19, wherein said displaying means displays an image of said designated one of said at least one closed area such that the displayed condition thereof changes periodically.

23. The embroidery data creating device according to claim 19, said attribute being one of a color, a shape of a stitch, a density of a stitch, a pitch of stitch, and a direction of a stitch.

24. The embroidery data creating device according to claim 19, further comprising a means for assigning priorities of said at least one closed area in accordance with said image data, wherein said designating means designates all of said closed areas one by one in accordance with the priorities assigned by said assigning means.

25. The method according to claim 1, wherein said step of designating includes a step of sequentially designating closed areas in response to an operation of an operation member.

26. The embroidery data creating device according to claim 4, wherein said designating means has an operation member, one of said at least one closed area being sequentially designated from among said at least one closed area displayed on said displaying means upon operation of said operation member.

27. The embroidery data creating device according to claim 19, wherein said designating means includes an operation member, one of said at least one closed area being sequentially designated from among said at least one closed area displayed on the displaying means in response to operation of said operation member.

* * * * *